US009155382B2

(12) United States Patent
Duffner

(10) Patent No.: US 9,155,382 B2
(45) Date of Patent: Oct. 13, 2015

(54) CLAMPING CHUCK

(71) Applicant: Zahoransky AG, Todtnau (DE)

(72) Inventor: Erich Duffner, March (DE)

(73) Assignee: Zahoransky AG, Todtnau (DE)

( * ) Notice: Subject to any disclaimer, the term of this patent is extended or adjusted under 35 U.S.C. 154(b) by 352 days.

(21) Appl. No.: 13/676,548

(22) Filed: Nov. 14, 2012

(65) Prior Publication Data

US 2013/0119595 A1 May 16, 2013

(30) Foreign Application Priority Data

Nov. 15, 2011 (DE) ..... 10 2011 118 638

(51) Int. Cl.

| | |
|---|---|
| ***B25B 1/00*** | (2006.01) |
| ***A46D 3/08*** | (2006.01) |
| ***B25B 5/06*** | (2006.01) |
| ***B25B 5/02*** | (2006.01) |
| ***B25B 5/14*** | (2006.01) |
| ***B25B 5/16*** | (2006.01) |

(52) U.S. Cl.

CPC . *A46D 3/087* (2013.01); *B25B 5/02* (2013.01); *B25B 5/06* (2013.01); *B25B 5/14* (2013.01); *B25B 5/16* (2013.01)

(58) Field of Classification Search

CPC ..... B25B 5/02; B25B 5/14; B25B 5/06; B25B 5/147; B25B 5/061; B24B 13/005; B24B 13/0031

USPC ..... 269/157, 216, 32, 212, 298, 43, 254 CS, 269/295, 156, 6

See application file for complete search history.

(56) References Cited

U.S. PATENT DOCUMENTS

| | | | | |
|---|---|---|---|---|
| 5,201,501 | A * | 4/1993 | Fassler | 269/32 |
| 7,820,942 | B1 * | 10/2010 | Lamsfuss | 219/121.82 |
| 2009/0140480 | A1 * | 6/2009 | Morfey | 269/171 |
| 2010/0289286 | A1 * | 11/2010 | Unmuth et al. | 294/106 |
| 2011/0024962 | A1 * | 2/2011 | Zhang | 269/107 |

FOREIGN PATENT DOCUMENTS

| | | |
|---|---|---|
| DE | 19625063 | 10/1997 |
| DE | 4234320 | 2/2006 |
| DE | 102006021466 | 11/2007 |

* cited by examiner

*Primary Examiner* — Lee D Wilson
*Assistant Examiner* — Seahee Yoon
(74) *Attorney, Agent, or Firm* — Volpe and Koenig, P.C.

(57) ABSTRACT

In a clamping chuck (1) for holding clamped a brush body (2), in particular a toothbrush body in its head region, including at least two clamping jaws (3*a*, 3*b*) spaced apart from one another in the longitudinal direction of the brush body (2) to be held, at least one of the clamping jaws (3*b*) is movable and is adjustable between an open position and a closed position which holds the brush body (2) clamped between the clamping jaws (3*a*, 3*b*). There is provided a brush body support (5) which is arranged between the clamping jaws (3*a*, 3*b*) and which is adjustable between a closed position acting on the rear side of the brush body (2) and an open position which is retracted with respect to said closed position. A common actuating mechanism (6) is provided for jointly adjusting the clamping jaw(s) (3*b*) and the brush body support (5) against a restoring force from the respective closed position into the open position (FIG. 5).

10 Claims, 1 Drawing Sheet

CLAMPING CHUCK

INCORPORATION BY REFERENCE

The following documents rea incorporated herein by reference as if fully set forth: German Patent Application No. DE 10 2011 118 638.0, filed Nov. 15, 2011

BACKGROUND

The invention relates to a clamping chuck for holding clamped a brush body, in particular a toothbrush body in its head region, comprising at least two clamping jaws spaced apart from one another in the longitudinal direction of the brush body to be held.

Brushes, in particular toothbrushes, are fed successively during production to a plurality of processing stations, for example a tufting device, a shearing device and a grinding device. Here, the brush bodies can be transported on a conveyor belt or a transport chain, with the individual brush bodies each being held in a clamping chuck.

It is desirable here for as many clamping chucks as possible to be arranged next to one another in the narrowest possible space so that the cycle width can be reduced and the switching times can be reduced and the processing of more brush bodies per unit time is possible. In addition, the wear must be reduced and it is possible for more brushes to be processed simultaneously on a grinding disk with a certain diameter if the clamping chucks in which the brush bodies are held are arranged closer to one another.

A problem, however, is that, in order to open the clamping chucks for inserting and removing a brush body, mechanical devices are required which require a certain minimum spacing between adjacent clamping chucks.

SUMMARY

It is therefore the object to provide a clamping chuck of the type mentioned at the outset which allows a tighter arrangement of the clamping chucks next to one another.

This object is achieved according to the invention in that at least one of the clamping jaws is movable and is adjustable between an open position and a closed position which holds the brush body clamped between the clamping jaws, in that there is provided a brush body support which is arranged between the clamping jaws and which is adjustable between a closed position acting on the rear side of the brush body and an open position which is retracted with respect to said closed position, and in that there is provided a common actuating mechanism for jointly adjusting the clamping jaws and the brush body support against a restoring force from the respective closed position into the open position.

As a result of the brush body support, the brush body to be held is supported on its rear side, and therefore the clamping jaws can be designed to be comparatively small while the brush body is nevertheless held securely in the clamping chuck. Since a common actuating mechanism is provided for the clamping jaws and the brush body support, the space requirement for this purpose is small, which means that the spacing between two clamping chucks on a transport chain or similar transport device can be kept correspondingly small.

It is particularly expedient here if the actuating mechanism has an actuating element which can be actuated in the longitudinal direction of the held brush body. Consequently, in order to actuate the clamping chuck, no elements projecting laterally beyond the latter are necessary, which means that two clamping chucks can be arranged laterally next to one another in a very tight manner, if appropriate even without spacing from one another.

Also conceivable would be an actuating element which can be actuated from above or below, that is to say at least approximately perpendicular to the holding plane defined by the held brush body. Here, too, no lateral elements projecting beyond the clamping chuck would be required.

A preferred embodiment provides that the actuating element is a slide, which is mounted in a linearly displaceable manner against the restoring force of a restoring spring with an application end for an application element of the adjustable clamping jaw and with a run-up slope for an application element for adjusting the brush body support.

This allows a simple mechanical construction of the actuating mechanism. The movable clamping jaw is usually displaced horizontally and the brush body support vertically. Consequently, the actuating element can actuate, by way of its free application end, the rear (in the actuating direction) clamping jaw, and the run-up slope situated between the application end and the actuating end can trigger the vertical movement of the brush body support. With the removal of the external force on the actuating end for opening the clamping chuck, the actuating element is moved back into its starting position by the restoring force, and the movable clamping jaw and also the brush body support are moved back into the respective closed position.

The movable clamping jaw(s) can preferably be mounted in a linearly displaceable manner. This allows a simple movement between the open position and the closed position and consequently a particularly simple and cost-effective construction of the actuating mechanism.

However, it is also possible that the movable clamping jaw(s) is(are) mounted pivotably.

Here, the movable clamping jaw(s) can also be of multipart design. In particular, two jaw wings acting in the end region of the brush body region to be clamped can be provided.

Modern toothbrushes often have functional elements on the side opposite the bristle area, for example soft plastic protrusions or ribs for care of the gums or for tongue cleaning. To ensure that such brush bodies can be securely held in the clamping chuck without damaging the functional elements, it is advantageous if the brush body support has a support surface tailored to the shape of the respective brush body. Here, the brush body support can have a counter-profiling designed to correspond to the profiling of the brush body side facing it.

In order to be able to adapt a clamping chuck quickly to different brush bodies having differently formed rear sides without having to exchange the entire clamping chuck, it is expedient if the brush body support has a base part and an exchange part which is detachably held thereon and which has the support surface. Thus, it is possible to exchange only the exchange part having the support surface.

It is possible here to provide between the base part and the exchange part a click fastening which allows a clip-like connection and detachment of the two parts without tools.

Alternatively, the brush body support together with the support surface can be a laser sintered part formed in one piece. This allows a simple production and a stable design of the brush body support.

In order to be able to adapt the clamping chuck to brush bodies of different sizes, one clamping jaw can be positioned and fixed in a respective working position independently of the opening and closing movement of another clamping jaw which is movable between an open and a closed position. Thus, the spacing of the clamping jaws in the closed position from one another can be varied by positioning one of the clamping jaws. Locking can take place for example via a locking device with a ball thrust screw which can be actuated via a setting wheel.

A brush body can be held clamped solely by the forces acting laterally from the clamping jaws. In order to reliably avoid an inadvertent release of the brush body from the clamping chuck in particular through the force acting from below via the brush body support, the clamping jaws can have, on their upper side and/or lower side, projections which in certain regions overlap the holding region of the brush body in the closed position. The clamping force of the clamping jaws can consequently be reduced and damage to the brush body caused by excessively high clamping forces can be avoided. Nevertheless, the brush body is held securely in the clamping cluck.

To insert a brush body into the clamping chuck, the clamping jaws must be spaced apart from one another in the open position to such an extent that the brush body region to be held can be introduced between the clamping jaws past the projections until the brush body lies on the brush body support. The closing movement of the movable clamping jaw causes the brush body to be pushed under the projections of the clamping jaws such that the brush body, on the one hand, is held clamped by the clamping jaws and, on the other hand, is fixed in the transverse direction thereto in the clamping chuck. In addition, the brush body is pressed against the projections in this transverse direction by the brush body support moved into its closed position, with the result that the brush body is held fixedly in the clamping chuck in each direction.

To achieve optimum holding of the brush body in the clamping chuck, it is expedient here if the actuating mechanism is designed in such a way that, during the closing movement, the brush body support comes into the respective closed position after the clamping jaws. Thus, the brush body is initially fixed between the clamping jaws and is then supported by the brush body support.

It may be expedient if the restoring force for adjusting the clamping jaws and/or the brush body support from the closed position into the respective open position can be set. This also allows the clamping chuck to be adapted to different brush bodies. For example, the restoring force for brush bodies made of softer material can be reduced in order to avoid damage caused by excessively high pressure.

In order to set the restoring force in a simple manner, it may be preferable in each case to provide a spring pin which can be positioned with a setting wheel and which acts on a restoring spring.

The ratio of the width of the brush body to be held to the width of the clamping chuck can be, in particular, between 0.7 and 1.0. Thus, on the one hand, there is space for securely receiving a brush body and for the mechanical components for the actuating mechanism and, on the other hand, the clamping chuck is only as wide as necessary such that an optimized number of clamping chucks can be arranged next to one another on a transport device.

The clamping chucks according to the invention can be mounted on different carriers, for example a transport chain (TC), a shuttle system, rotary indexing tables, sliders, robot receptacles or self-propelled transport units. Depending on the type of arrangement of the clamping chucks, a brush body can also be tufted with bristle clusters while it is held in the clamping chuck.

BRIEF DESCRIPTION OF THE DRAWINGS

An exemplary embodiment of a clamping chuck according to the invention is explained in more detail below with reference to the drawings, in which.

DETAILED DESCRIPTION OF THE PREFERRED EMBODIMENTS

As shown in the figures, a clamping chuck, designated overall by 1, for holding clamped a brush body 2 comprises two spaced-apart clamping jaws 3*a*, 3*b* which are mounted on a base body 4.

Figure 4:
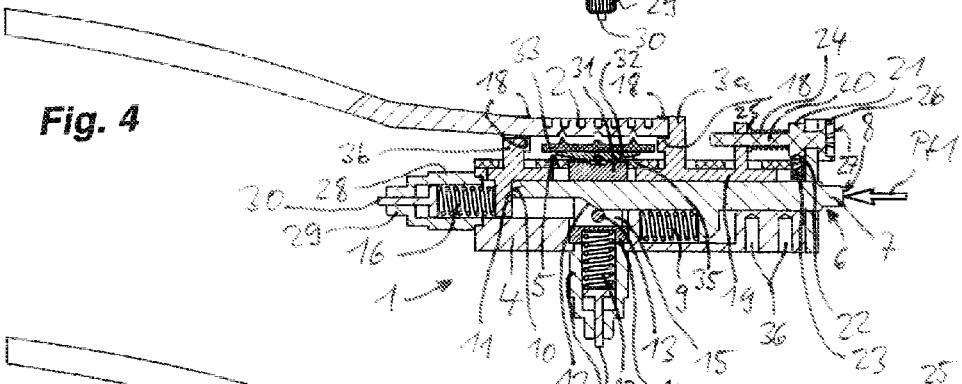
FIG. 4 shows a lateral cross-sectional representation of the clamping chuck in the open position of the clamping jaws and of the brush body support.
Figure 5:
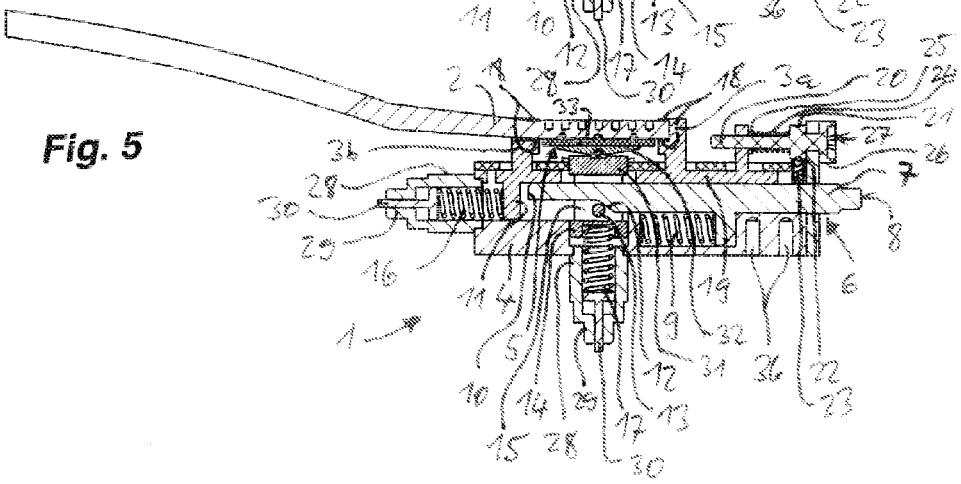
FIG. 5 shows a lateral cross-sectional representation of the clamping chuck in a closed position of the clamping jaws and of the brush body support.

One of the clamping jaws, referred to below as fixed clamping jaw 3*a*, can be fixed on the base body 4 in a working position, and the other, movable clamping jaw 3*b* is adjustable between an open position (FIG. 4) and a closed position (FIG. 5) by an actuating mechanism 6 (FIGS. 4, 5).

The brush body 2, here a toothbrush body, is brought with its head region between the clamping jaws 3*a*, 3*b* situated in the open position. After adjusting the movable clamping jaw 3*b* into its closed position, the brush body 2 is held clamped between the clamping jaws 3*a*, 3*b*. In addition, the brush body 2 lies on a brush body support 5 (FIGS. 2 to 5) which, in turn, is adjustable between an open position and a closed position and acts on the brush body 2 from below in the closed position.

In order to adjust the movable clamping jaw 3*b* and the brush body support 5 from the respective closed position into the open position, a common actuating mechanism 6 is provided which is described more precisely below.

As shown in FIG. 4, the movable clamping jaw 3*b* is situated in its open position, as is the brush body support 5. For this purpose, an actuating element 7 designed as a slide which is mounted in a linearly displaceable manner in the base body 4 has a force (arrow Pf1) applied to it, at its end 8 situated outside the base body 4, against the restoring force of a restoring spring 9. With its application end 10 opposite the outer end 8, the actuating element 7 presses against an application element 11 of the adjustable clamping jaw 3*b* and consequently pushes this away from the fixed clamping jaw 3*a*.

A run-up slope 12 on the actuating element 7 cooperates with an application element 13, designed as an opening roller, of the brush body support 5. Here, the brush body support 5 has a cylinder 14 displaceably mounted vertically in the base body 4, the actuating element 7 being guided through a cutout 15 in the cylinder 14. Both the cylinder 14 and the application element 11 of the movable clamping jaw 3*b* are each assigned a restoring spring 16, 17 which passes the respective element into the respective closed position.

By applying the actuating element 7, both the movable clamping jaw 3*b* and the brush body support 5 are brought into their respective open position (FIG. 4). In this position, a brush body 2 is inserted into the clamping chuck 1. Both clamping jaws 3*a*, 3*b* have, on their upper side and lower side, a respective projection 18 which overlaps the region of the brush body 2 to be held. Therefore, during insertion, the brush body 2 is first introduced at a spacing from the end sides of the clamping jaws 3*a*, 3*b* oriented in the closing direction and is deposited on the brush body support 5 or held slightly above it. By removing the application force on the end 8 of the actuating element 7, the movable clamping jaw 3*b* is moved toward the fixed clamping jaw 3*a* and the brush body 2 is pushed between the projections 18 of the clamping jaws 3*a*, 3*b*. Thus, on the one hand, the brush body 2 is held clamped between the clamping jaws 3*a*, 3*b* in the longitudinal direction and, on the other hand, is also fixed in a vertical direction between the projections 18. The actuating mechanism 6 is constructed in such a way that, only after the movable clamping jaw 3*b* has been adjusted into its closed position, the cylinder 14 is pressed upwardly by the restoring spring 17 and the brush body support 5 thus comes into its closed position in which it acts on and supports the brush body 2 from below (FIG. 5).

The brush body support 5 can also be mounted displaceably in the spacing direction of the clamping jaws 3*a*, 3*b* in order to be able to better participate in the closing movement of the clamping jaw 3*b* when, during the closing of the clamping jaw 3*b*, the brush body 2 already lies on the brush body support 5. Here, a restoring force can press the brush body support 5 against the closing movement into the insertion position.

Figure 2:
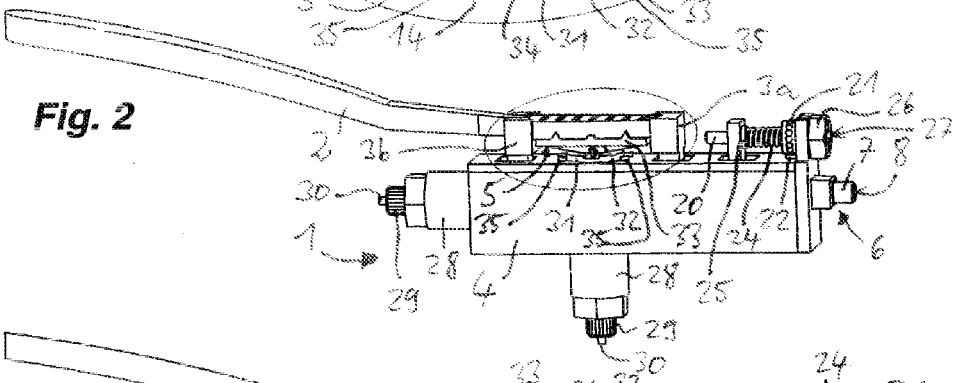
FIG. 2 shows a perspective view of the clamping chuck from FIG. 1.

The restoring springs 16, 17 are each mounted in a spring housing 28 on the base body 4 (FIGS. 2, 4, 5). The basic tension of the restoring springs 16, 17 can be set by means of a setting wheel 29 which via a thread and counter-thread, which are not shown in more detail, cooperates with a spring pin 30 acting on the respective restoring spring 16, 17. It is thus possible to set the force required to adjust the clamping jaw 3*b* and the brush body support 5 into the respective open position or the force with which the clamping jaw 3*b* and the brush body support 5 press against the brush body 2 and hold it in the closed position.

It is also possible to remove the spring housing 28 from the base body 4 and to exchange the restoring springs 16, 17. For this purpose, the spring housing 28 can be detachably fastened to the base body 4, for example via a thread or a bayonet fastening.

Since the actuating element 7 can be actuated in the longitudinal direction of the brush body 2, virtually in the extension thereof, no elements projecting laterally beyond the clamping chuck 1 are required for adjusting the clamping chuck 1 into the open position, with the result that a plurality of clamping chucks 1 can be arranged very tightly or even directly against one another and nevertheless still be actuated.

In order to actuate the clamping chuck 1, the outer end 8 of the actuating element 7 can have a roller, which is not shown in more detail, which, during the advancing of the clamping chuck, for example on a transport chain, moves against a fixed run-up slope and moves the actuating element 7 into the base body 4. During further movement of the clamping chuck 1, the actuating element 7 passes again outside the region of the run-up slope and is returned again into the inoperative position by means of the restoring springs 9, 16, 17.

For adaptation to different brush bodies 2, the clamping jaw 3*a* can be positioned and can be fixed in a respective working position. For this purpose, the clamping jaw 3*a* is arranged on a slider 19 mounted in a linearly displaceable manner in the base body 4 (FIGS. 2, 4, 5). This slider can be adjusted by a screw 20, wherein locking in a desired working position takes place via a locking means 21 on the screw 20 into which there engages a locking ball 22 which is pressed with a compression spring 23 onto the locking means 21 of the screw 20. A spring 24 on the screw shaft eliminates any thread play and a sliding disk 25 prevents the spring 24 being stressed in torsion when setting the clamping jaw 3*a*. On the actuation side, the screw 20 has a setting wheel 26 which additionally has an inner profiling 27. This inner profiling 27 allows an engagement of an adjusting tool in order to adjust the clamping jaw 3*a* automatically into a desired working position. Here, too, an adjustment of the clamping jaw 3*a* is possible if a plurality of clamping chucks 1 are arranged tightly next to one another.

Figure 3:
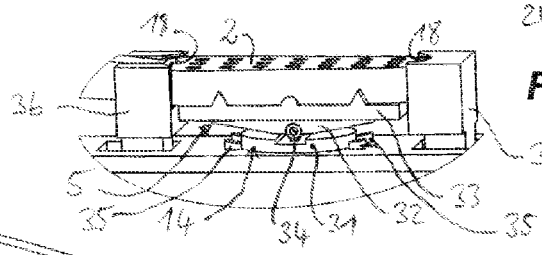
FIG. 3 shows a detail view of the clamping chuck from FIG. 2 in the region of the clamping jaws.

As can be seen in particular in FIG. 3, the brush body support 5 has a support surface 33 adapted to the shape of the respective brush body 2. The brush body support 5 has, for this purpose, a base part 31 and an exchange part 32 which is detachably held thereon and which has the support surface 33.

As a result, the clamping chuck 1 can be adapted rapidly and simply to different brush bodies 2 such that, even in the case of brush bodies 2 with rear profilings or projecting functional parts, it is ensured that the brush body 2 is supported in a stable manner and securely held.

A cylindrical holding element 34 is provided on the base part 31 and a corresponding cutout is provided on the exchange part 32, with the result that the exchange part 32 can be connected in a clip-like manner to the base part 31 and separated therefrom again. This type of fastening additionally allows a slight rotation or a "seesawing" of the exchange part, which, on the one hand, can facilitate the insertion of the brush body 2 in particular with relatively pronounced profiling and, on the other hand, has the effect that tolerances of different brush bodies 2 when acted upon in the closed position can be compensated for.

As shown in FIG. 3 supporting elements 35 are provided on the base body, on which elements the exchange part 32 bears in the open position (FIG. 4) such that it is arranged in a defined position and orientation.

Figure 1:
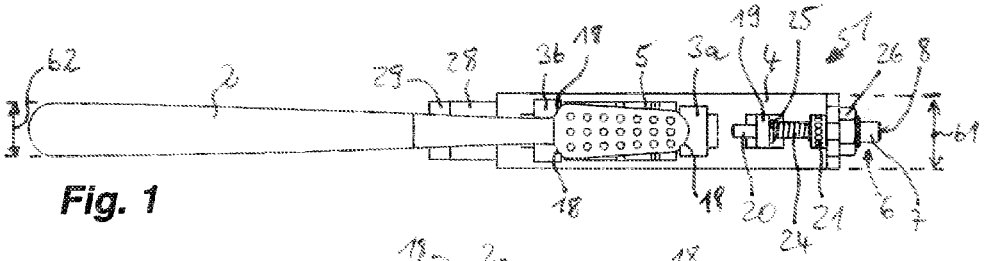
FIG. 1 shows a plan view of a clamping chuck with a brush body held therein.

As can be seen in FIG. 1, the clamping chuck 1 is only slightly wider than the brush body 2 held therein. The ratio of the width b2 of the brush body 2 to be held to the width b1 of the clamping chuck 1 can preferably be between 0.7 and 1. There thus results a particularly narrow and space-saving design of the clamping chuck 1. Since, in order to actuate the actuating mechanism 6, no elements projecting laterally beyond the clamping chuck 1 are necessary, it is possible for a plurality of clamping chucks, for example on a transport chain, to be arranged very close to one another or also directly against one another, such that more brush bodies can be processed in a shorter time. Cycle widths and hence switching times can be reduced, with the result that a lower degree of wear can occur.

If bristled brush bodies are to be processed on a grinding disk, a plurality, or, given a predetermined grinding disk diameter, a larger number, of brush bodies arranged in adjacent clamping chucks 1 can be processed at the same time.

In order to detachably mount the clamping chuck 1 on a transport chain or similar transport device, as shown in FIGS. 4 and 5 the base body 4 is provided on its lower side with two fastening bores 36 by means of which the clamping chuck 1 can be fitted onto corresponding pins of the transport device. Consequently, a rapid and precise mounting and removal of the clamping chucks 1 is possible.

The invention claimed is:

1. A clamping chuck (1) for holding clamped a brush body (2), comprising at least two clamping jaws (3*a*, 3*b*) spaced apart from one another in a longitudinal direction of the brush body (2) to be held, at least one of the clamping jaws (3*b*) is movable and is adjustable between an open position and a closed position which holds the brush body (2) clamped between the clamping jaws (3*a*,3*b*), a brush body support (5) which is arranged between the clamping jaws (3*a*, 3*b*) and which is adjustable between a closed position acting on a rear side of the brush body (2) and an open position which is retracted with respect to said closed position, and a common actuating mechanism (6) for jointly adjusting at least one of the clamping jaws (3*b*) and the brush body support (5) against a restoring force from the respective closed positions into the open positions, the actuating mechanism (6) has an actuating element (7) which is actuatable in a longitudinal direction of the held brush body (2), and the actuating element (7) is a slide, which is mounted in a linearly displaceable manner against the restoring force of a restoring spring (9), and has an application end (10) for an application element (11) of the adjustable clamping jaw (3*b*) and a run-up slope (12) for an application element (13) for adjusting the brush body support (5).

2. The clamping chuck according to claim 1, wherein the at least one movable clamping jaw (3*b*) is mounted in a linearly displaceable manner.

3. The clamping chuck according to claim 1, wherein the brush body support (5) has a support surface (33) tailored to a shape of the respective brush body (2).

4. The clamping chuck according to claim 3, wherein the brush body support (5) has a base part (31) and an exchange part (32) which is detachably held thereon and which has the support surface (33).

5. The clamping chuck according to claim 3, wherein the brush body support (5) together with the support surface (33) is a laser sintered part formed in one piece.

6. The clamping chuck according to claim 1, wherein one of the clamping jaws (3*a*) is positionable and fixable in a respective working position independently of an opening and closing movement of the clamping jaw (3*b*) which is movable between the open and the closed position.

7. The clamping chuck according to claim 1, wherein the clamping jaws (3*a*, 3*b*) have, on at least one of an upper side or a lower side thereof, projections (18) which in certain regions overlap a holding region of the brush body (2) in the closed position.

8. The clamping chuck according to claim 1, wherein the actuating mechanism (6) is configured such that, during a closing movement, the brush body support (5) comes into the respective closed position after the clamping jaws (3*a*, 3*b*).

9. The clamping chuck according to claim 1, wherein a ratio of a width (b2)of the brush body (2) to be held to a width (b1) of the clamping chuck (1) is between 0.7 and 1.0.

10. A clamping chuck (1) for holding clamped a brush body (2), comprising at least two clamping jaws (3*a*, 3*b*) spaced apart from one another in a longitudinal direction of the brush body (2) to be held, at least one of the clamping jaws (3*b*) is movable and is adjustable between an open position and a closed position which holds the brush body (2) clamped between the clamping jaws (3*a*, 3*b*), a brush body support (5) which is arranged between the clamping jaws (3*a*, 3*b*) and which is adjustable between a closed position acting on a rear side of the brush body (2) and an open position which is retracted with respect to said closed position, and a common actuating mechanism (6) for jointly adjusting at least one of the clamping jaws (3*b*) and the brush body support (5) against a restoring force from the respective closed positions into the open positions, wherein the restoring force for adjusting at least one of the clamping jaws (3*b*) or the brush body support (5) from the closed position into the respective open position is settable, and in order to set the restoring force, in each case a spring pin (30) which is positionable with a setting wheel (29) and which acts on a restoring spring (16, 17) is provided.

* * * * *